US008424512B2

(12) United States Patent
Dettloff

(10) Patent No.: US 8,424,512 B2
(45) Date of Patent: Apr. 23, 2013

(54) MODULAR RANGE SYSTEM AND METHOD AND SPACE SAVER BURNER SYSTEM

(75) Inventor: Stan Dettloff, Kings Mountain, NC (US)

(73) Assignee: ITW Food Equipment Group LLC, Troy, OH (US)

( * ) Notice: Subject to any disclaimer, the term of this patent is extended or adjusted under 35 U.S.C. 154(b) by 1464 days.

(21) Appl. No.: 12/034,223

(22) Filed: Feb. 20, 2008

(65) Prior Publication Data

US 2008/0202493 A1 Aug. 28, 2008

Related U.S. Application Data

(60) Provisional application No. 60/977,228, filed on Oct. 3, 2007, provisional application No. 60/890,646, filed on Feb. 20, 2007.

(51) Int. Cl.
*F24C 5/00* (2006.01)

(52) U.S. Cl.
USPC ..... 126/39 B; 126/9 R; 126/9 B; 29/428; 312/108

(58) Field of Classification Search ..... 126/39 B, 126/9 R, 9 B, 19 R, 273 R; 29/428; 312/111, 312/108
See application file for complete search history.

(56) References Cited

U.S. PATENT DOCUMENTS

| | | | |
|---|---|---|---|
| 1,991,573 | A | 2/1935 | Pickup |
| 3,033,188 | A | 5/1962 | Cline et al. |
| 3,474,724 | A | 10/1969 | Jenn |
| 3,746,417 | A | 7/1973 | Sasnett |
| 3,797,375 | A | 3/1974 | Cerola |
| 4,042,806 | A | 8/1977 | McCartney |
| 4,245,615 | A | 1/1981 | Moss |
| 4,409,954 | A | 10/1983 | Berlik et al. |
| 4,413,610 | A | 11/1983 | Berlik |
| 4,457,293 | A | 7/1984 | Berlik |
| 5,190,026 | A | 3/1993 | Doty |
| 5,249,567 | A | 10/1993 | Maitland et al. |
| 5,775,316 | A | 7/1998 | Jones |
| 6,148,812 | A | 11/2000 | Taplan et al. |
| 6,230,701 | B1 | 5/2001 | Schultheis et al. |
| 6,877,825 | B2 | 4/2005 | Khosropour et al. |
| 6,905,332 | B1 | 6/2005 | Neal et al. |
| 2003/0227240 | A1 | 12/2003 | Khosropour et al. |
| 2006/0049725 | A1 | 3/2006 | Simon |

FOREIGN PATENT DOCUMENTS

| | | |
|---|---|---|
| GB | 2311128 | 9/1997 |
| WO | WO 2007/062444 | 7/2004 |

OTHER PUBLICATIONS

PCT, International Search Report and Written Opinion, International Application No. PCT/US2011/046564 (Feb. 17, 2012).

*Primary Examiner* — Alfred Basichas
(74) *Attorney, Agent, or Firm* — Thompson Hine LLP

(57) ABSTRACT

A modular range system and method utilizes a plurality of base units and a plurality of top units that may be assembled in numerous configurations to achieve a variety of range unit configurations. The top units may be preassembled with specific cooking system types prior to mounting onto the base units. Preassembled top units may each include a laterally extending gas manifold that can be coupled together upon range assembly to form a common, laterally extending gas manifold for the overall range unit. Range unit configurations are also described.

19 Claims, 15 Drawing Sheets

MODULAR RANGE SYSTEM AND METHOD AND SPACE SAVER BURNER SYSTEM

CROSS-REFERENCES

This application claims the benefit of U.S. provisional application Ser. No. 60/977,228 filed Oct. 3, 2007 and U.S. provisional application Ser. No. 60/890,646 filed Feb. 20, 2007, the entirety of each of which is incorporated herein by reference.

TECHNICAL FIELD

This application relates generally to a modular system for manufacturing a line of range products having a variety of widths and a variety of top cooking configurations.

BACKGROUND

Restaurant ranges are available in a variety of sizes and cooktop configurations. Some ranges may have only a single cooking system type, while others may include two or more cooking system types. To satisfy the needs of the market, range manufacturers typically provide a full line of range sizes and cooktop configurations, which increases manufacturing complexity and cost. The most common types of cooking system types include open top burners, manual griddle, thermostatic griddle, step-up rear burner, raised griddle/broiler and charbroiler. As commonly used in the industry, and as used herein, the term "range" includes, without limitation, units having one or more of the foregoing cooking system types.

It would be desirable to provide a versatile method of producing a full line of range units. It would also be desirable to provide range units that are readily modified in the field to provide different cooktop configurations.

SUMMARY

In one aspect, a method of manufacturing range units of a variety of configurations and sizes is provided, where each range unit includes a cooktop assembly supported atop a base assembly. The method involves:

providing a modular base system including first, second and third base units of different widths WB1, WB2 and WB3 respectively, where WB1<WB2<WB3;

providing a modular cooktop system including first, second and third cooktop units of different widths WT1, WT2 and WT3 respectively, where WT1<WT2<WT3;

(1) when manufacturing a first range unit having a specified width WU1 and cooktop configuration C1:

utilizing the first and third base units and the third cooktop unit to assemble the first range unit, where WT3=(WB1+WB3)=WU1;

(2) when manufacturing a second range unit having a specified width WU1 and cooktop configuration C2:

utilizing the first and third base units and the first and second cooktop units to assemble the second range unit, where (WT1+WT2)=(WB1+WB3)=WU1.

In another aspect, a method of manufacturing range units of a variety of configurations and sizes is provided, where each range unit includes a cooktop assembly supported atop a base assembly. The method involves:

providing a modular base system including first, second and third base units of different widths respectively;

providing a modular cooktop system including first, second and third cooktop units of different widths respectively;

(1) when manufacturing a first range unit having a first specified width and a first cooktop configuration:

utilizing the first and third base units and the third cooktop unit to assemble the first range unit;

(2) when manufacturing a second range unit having the first specified width and a second cooktop configuration that is different than the first cooktop configuration:

utilizing the first and third base units and the first and second cooktop units to assemble the second range unit;

(3) when manufacturing a third range unit having a second specified width that is greater than the first specified width:

utilizing two third base units and the second and third cooktop units to assemble the third range unit.

In a further aspect, a method of manufacturing a range unit is provided, where the range unit includes a cooktop assembly supported atop a base assembly. The method involves: preassembling a plurality of cooktop units with respective cooking system types, each preassembled cooktop unit including a laterally extending gas manifold mounted thereon; receiving an order for a specific range unit; identifying from among the plurality of preassembled cooktop units at first and second preassembled cooktop units for use in manufacture of the specific range unit; mounting the first and second preassembled cooktop units upon a base assembly with one end of the laterally extending gas manifold of the first preassembled cooktop unit in alignment with one end of the laterally extending gas manifold of the second preassembled cooktop unit and coupling the one end of the laterally extending gas manifold of the first preassembled cooktop unit to the one end of the second preassembled cooktop unit to form a common, laterally extending gas manifold for the specific range unit.

In still another aspect, a method of in-field reconfiguration of a range unit is provided. The method involves: constructing the range unit with a cooktop assembly supported atop a base assembly, where the cooktop assembly defines the cooktop configuration of the range unit, the cooktop assembly made up of at first and second cooktop units; removing the first cooktop unit from the range unit in the field, where the first cooktop unit includes a first cooking system type; replacing the first cooktop unit in the field with a third cooktop unit having a second cooking system type that is different than the first cooking system type.

The cooktop units and base units may be of frame-type or non-frame type construction.

Range unit configurations achieved via the manufacturing process are also provided.

A gas cooktop unit includes an open top gas burner arrangement including a front row burner row and a rear burner row. The front burner row including at least four front burners spaced apart by no more 9.5" from burner center to burner center. The rear burner row including at least three rear burners spaced apart by at least 10.5" from burner center to burner center.

DETAILED DESCRIPTION

Figure 1:
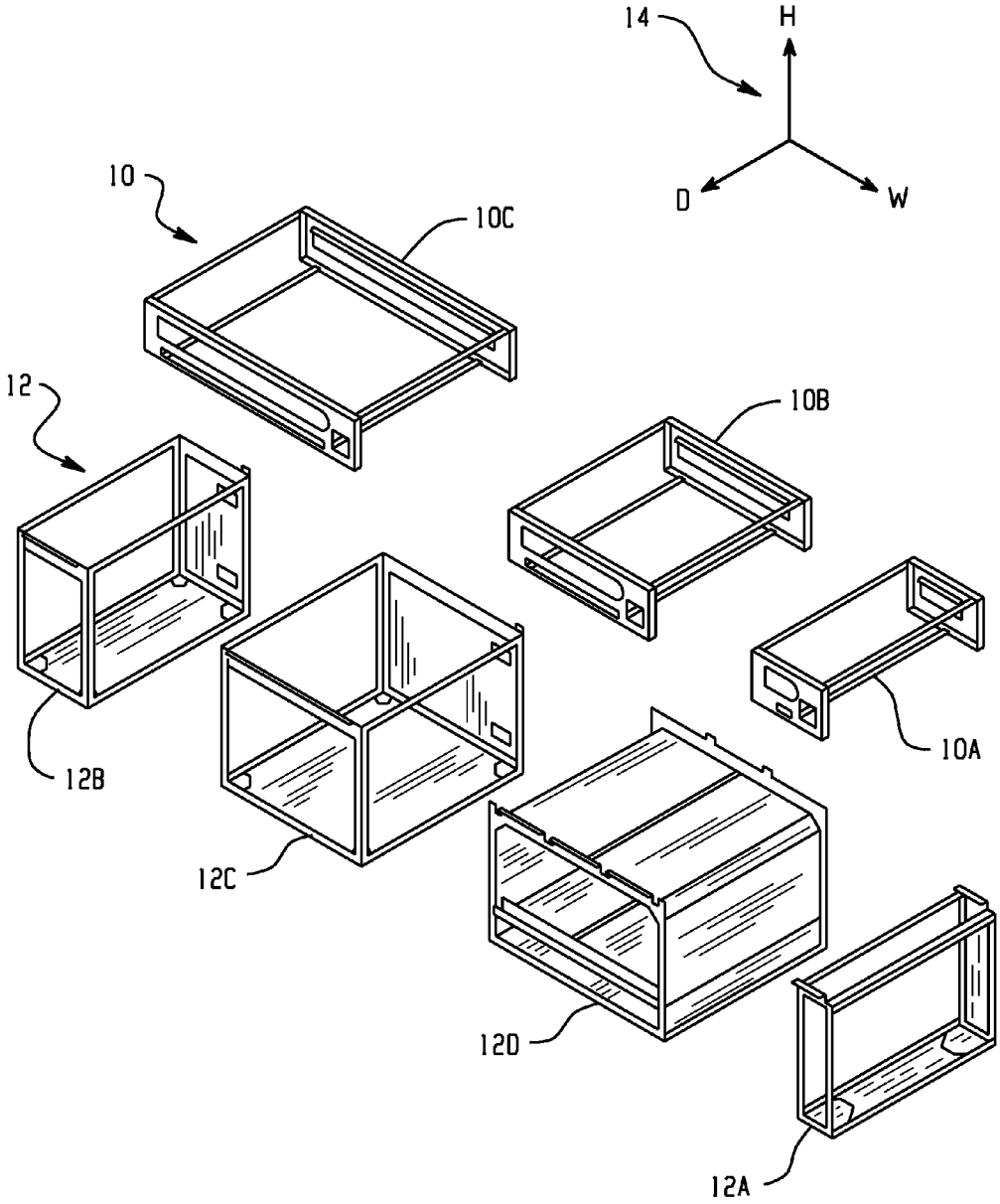
FIG. 1 illustrates the top and base frame units in accordance with one implementation of a modular range frame system.

Referring to FIG. 1, one embodiment of a range frame system is shown, including a plurality of top frame units 10 and a plurality of base frame units 12. The top frame units 10A-10C have a common height (H) and depth (D), but different widths (W), where such dimensions are defined in the direction of the illustrated coordinate system 14. In one implementation, the width of top frame unit 10A may be 12", the width of top frame unit 10B may be 24" and the width of top frame unit 10C may be 36". The base frame units 12A-12D have a common height and depth, but different widths. In one implementation, the width of base frame unit 12A is 6", the width of base frame unit 12B is 12", the width of base frame unit 12C is 124" and the width of base frame unit 12D is 30". The height of the base frame units is preferably 2-3 times the height of the top frame units. The frame system can advantageously be utilized to manufacture a variety of range sizes and configurations as will now be described. While the following discussion focuses on the use of cooktop units and base units formed in part by frames, it is recognized that a similar system could be implemented in which the cooktop units and base units are manufactured from some form of non-frame technique, and thus the scope of the disclosure embodied herein, and various features detailed, applies similarly to cooktop units and base units of non-frame construction.

Figure 2:
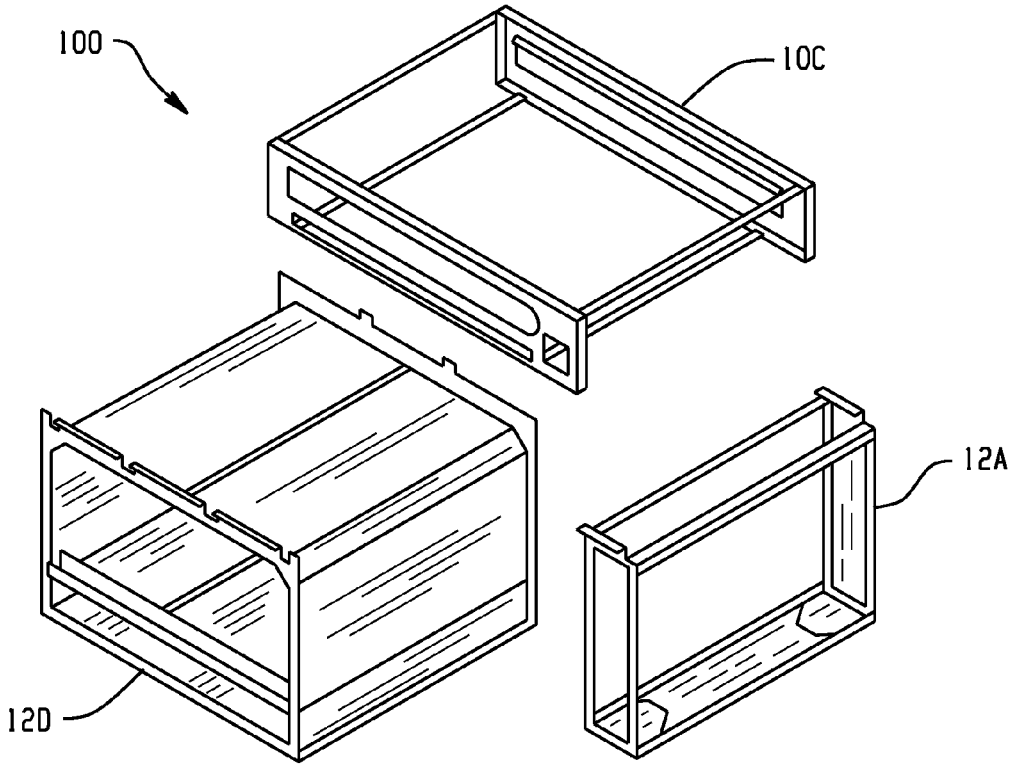
FIGS. 2 and 3 show frame exploded and frame assembled views of one range unit configuration.
Figure 3:
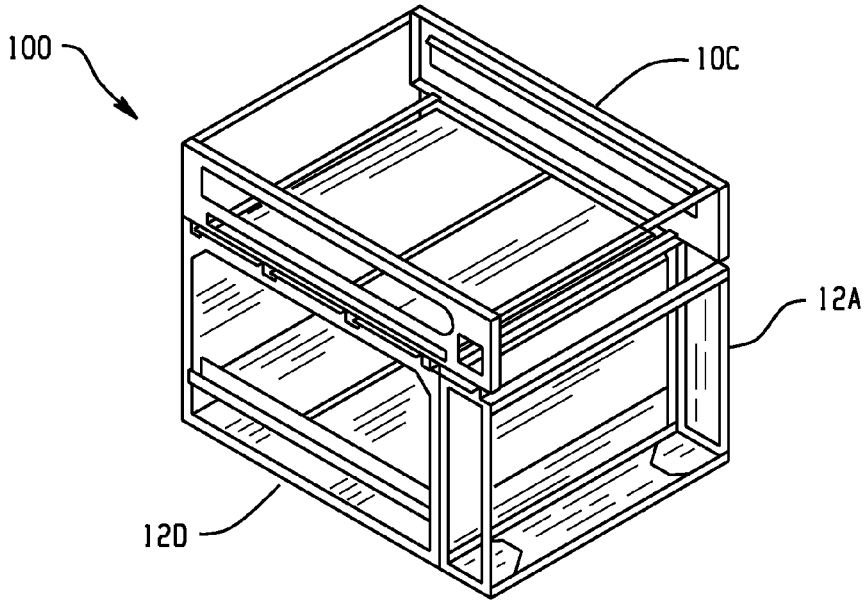

Referring to FIGS. 2 and 3 a range unit configuration 100 is shown in frame exploded and frame assembled views, where the top frame assembly is formed by top frame unit 10C and the base frame assembly is formed by joined base frame units 12A and 12D. In this configuration the width of the range unit 20 is the same as the width of the top frame unit 10C, and the combined width of base frame units 12A and 12D is the same as the width of top frame unit 10C. In one implementation configuration 100 is a 36" wide range unit.

Figure 4:
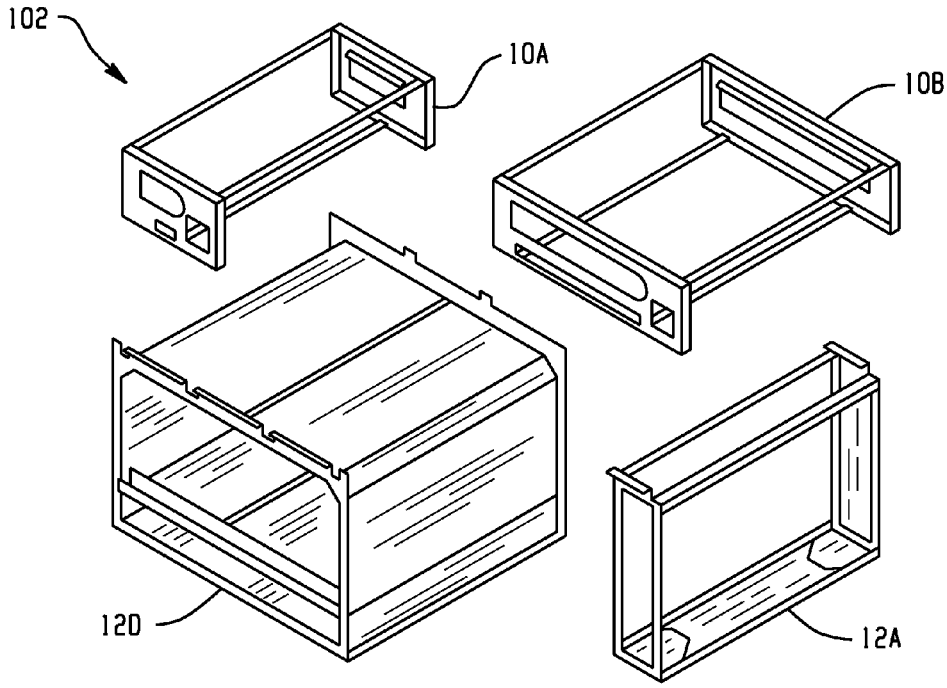
FIGS. 4 and 5 show frame exploded and frame assembled views of another range unit configuration.
Figure 5:
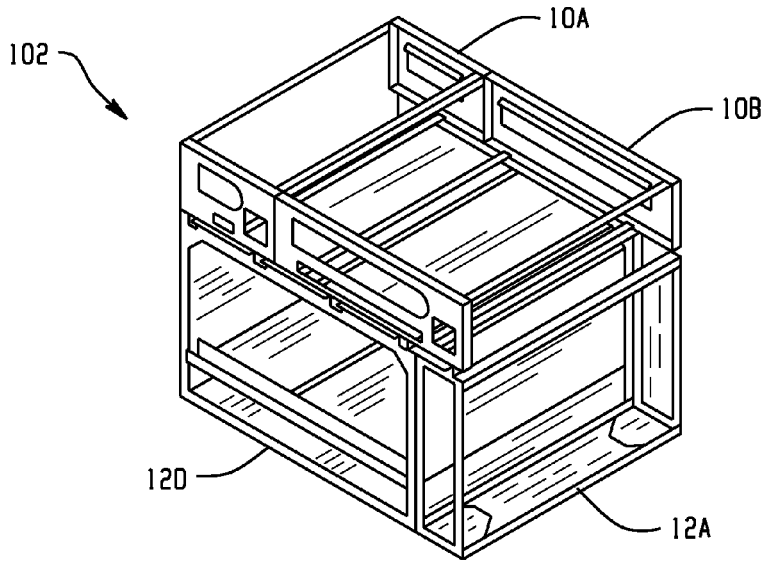

FIGS. 4 and 5 illustrate another range unit configuration 102 in which the top frame assembly is formed by top frame units 10A and 10B, and the base frame assembly is formed by joined base frame units 12A and 12D. Range unit 102 has the same width as range unit 100, but is different in the configuration of the top frame assembly. Range unit configuration 100 is used to produce a unit has only a single top cooking system type (e.g, only open top burners or only charbroiler or only manual griddle), and range unit configuration 102 is used to produce a unit that has two different top cooking system types (e.g., open top burner next to manual griddle or open top burner next to charbroiler or thermostatic griddle next to charbroiler).

In this regard, each of the top frame units 10A, 10*b* and 10C may be preassembled (in the same plant or at another location and shipped to the assembly plant) with a specific top cooking system type before being mounted on the base frame assembly during the manufacturing process. In this manner, when an order for a range unit of specific size and cooktop configuration is received, the appropriate preassembled top frame units may be selected and then mounted to the base frame assembly. Thus, in the range manufacturing/assembly plant, a supply of preassembled top frame units may stocked and ready for use when an order comes in. The number of each type of preassembled top frame unit maintained in stock ready for assembly may be set in accordance with the demand for different range configurations (e.g., if range units that will require a 12" width open top burner section are typically ordered at a rate that is three times greater than range units that will require a 12" width charbroiler, then the maintained stock of top frame units 10A preassembled with open top burners may be three times the maintained stock of top frame units 10A preassembled with a charbroiler). However, it is also recognized that the preassembly of the top frame units may occur in the manufacturing/assembly facility itself in response to a customer order. Accordingly, as used herein the term "preassembled" when referring to a top frame unit and a cooking system types is intended to refer to assembly of the cooking system type into the top frame unit prior to mounting the top frame unit on the base frame assembly.

The base frame unit 12D may be preassembled as a standard oven or as a convection oven. Typically, the base frame unit 12A can be used, and in some cases preassembled, as a control panel for the range unit. Base frame units 12B and 12C may be used primarily as cabinets, though incorporating controls or standard or convection oven technology into such units is possible.

Figure 6:
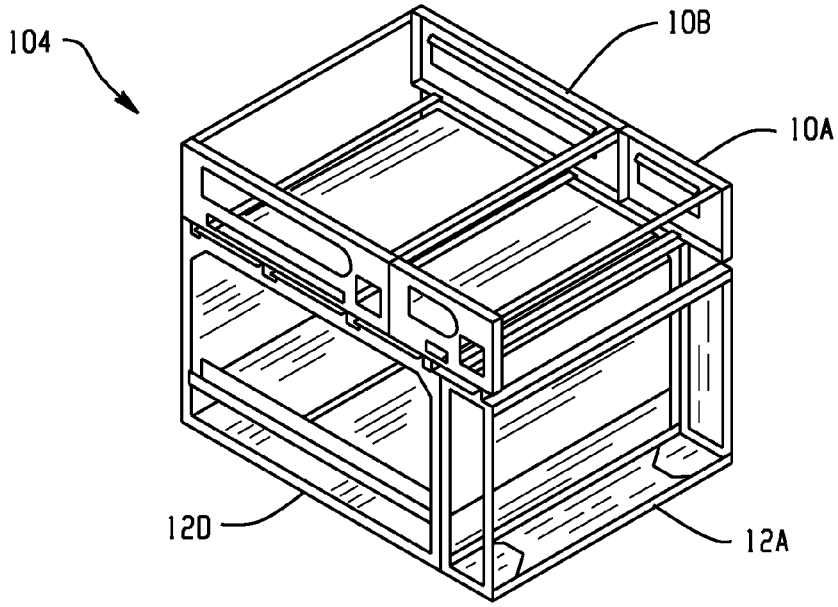
FIG. 6 shows a frame assembled view of another range unit configuration.

Referring now to FIG. 6, a range unit configuration 104 is illustrated that uses the same frame units as range unit configuration 102 (FIGS. 4 and 5), but reverses the position of the top frame units 10A and 10B. So, for example, range unit 102 could represent a configuration with a 24" width of open top burners located to the right of a 12" width manual griddle, and range unit 104 could represent a configuration with a 24" width of open top burners located to the left of a 12" width manual griddle. Providing this type of variability facilitates accommodation of the large variety of needs that are requested in the range market based upon kitchen configuration and chef preference.

Figure 7:
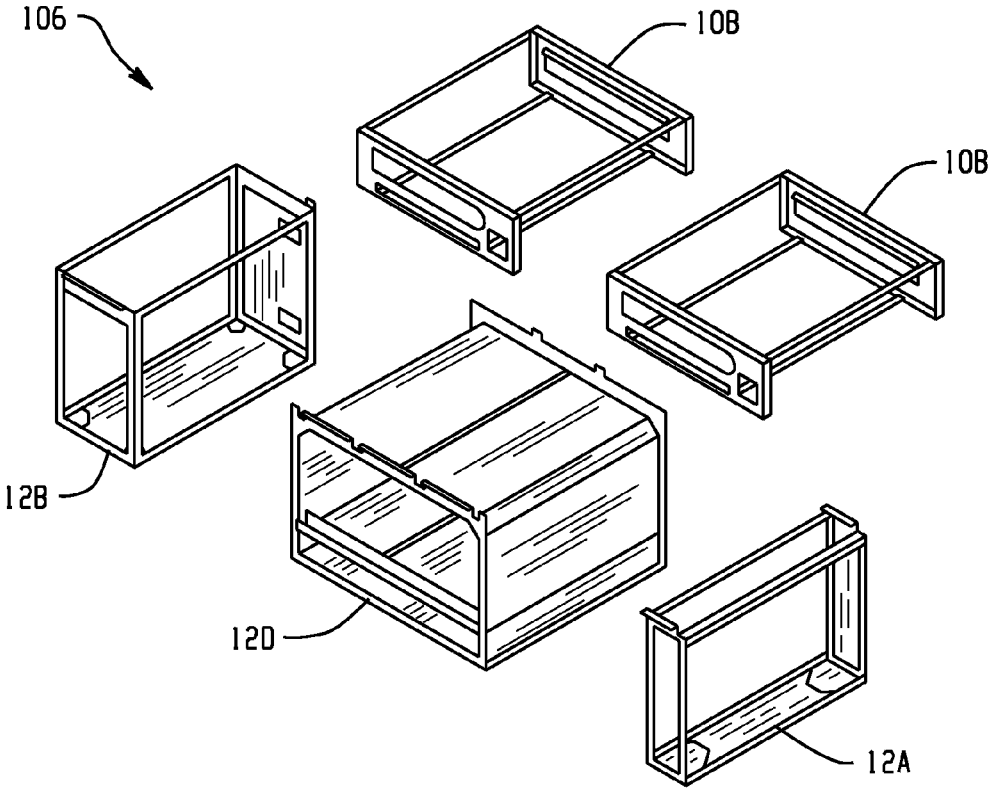
FIGS. 7 and 8 show frame exploded and frame assembled views of another range unit configuration.
Figure 8:
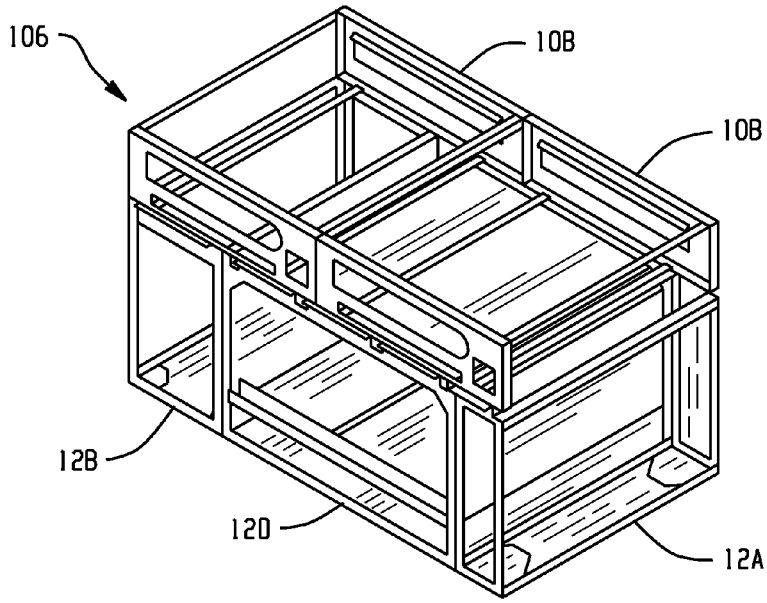

FIGS. 7 and 8 illustrate a range unit configuration 106 in which the to frame assembly is made up of two top frame units 10B and the base frame assembly is made up of joined base frame units 12A, 12B and 12D. The two top frame units 10B could be preassembled with the same type cooking system or with respective different type cooking systems as needed. In one implementation range unit 106 is a 48" wide range unit.

Figure 9:
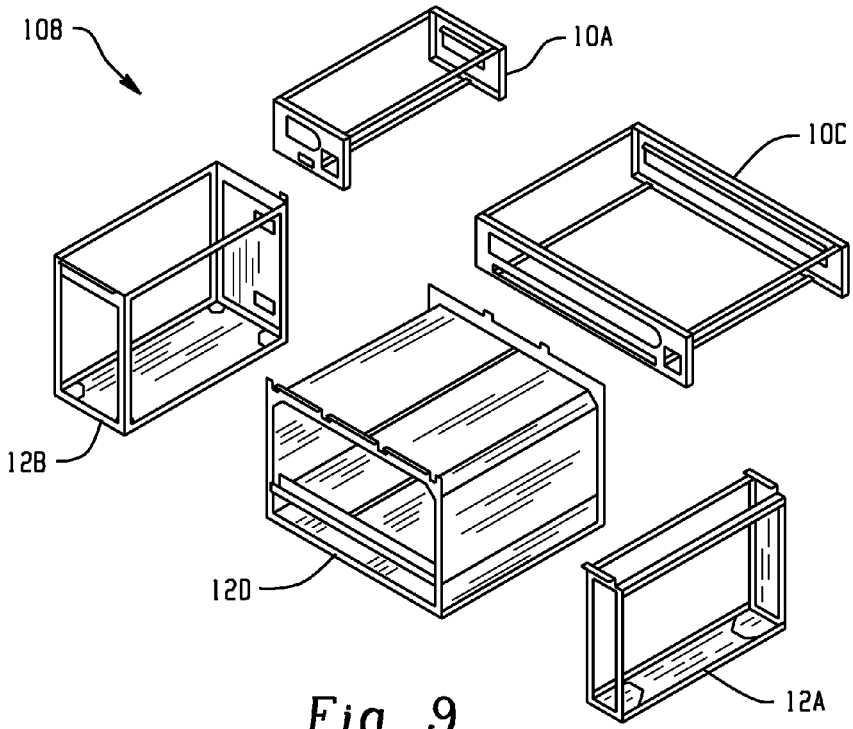
FIGS. 9 and 10 show frame exploded and frame assembled views of another range unit configuration.
Figure 10:
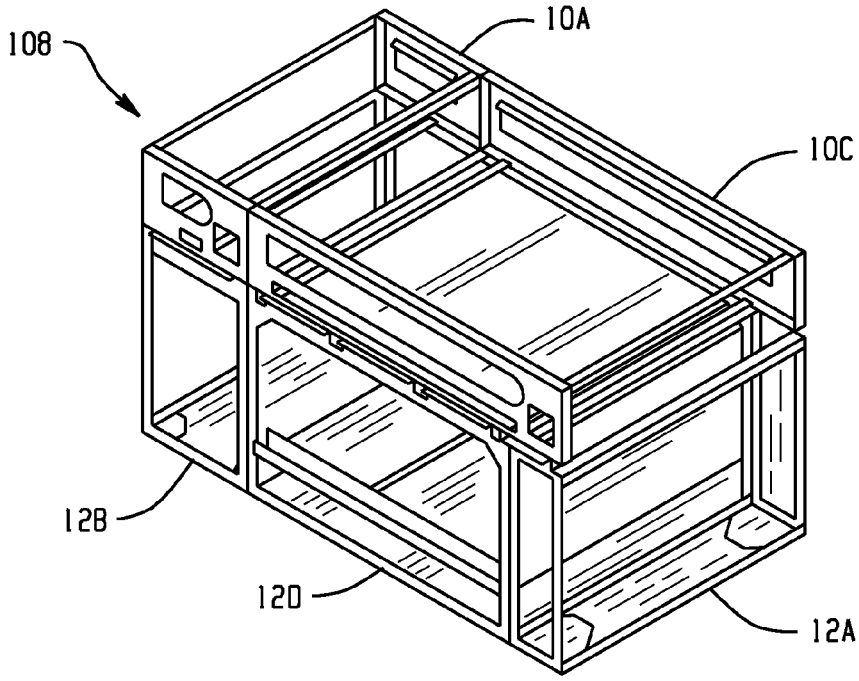
Figure 11:
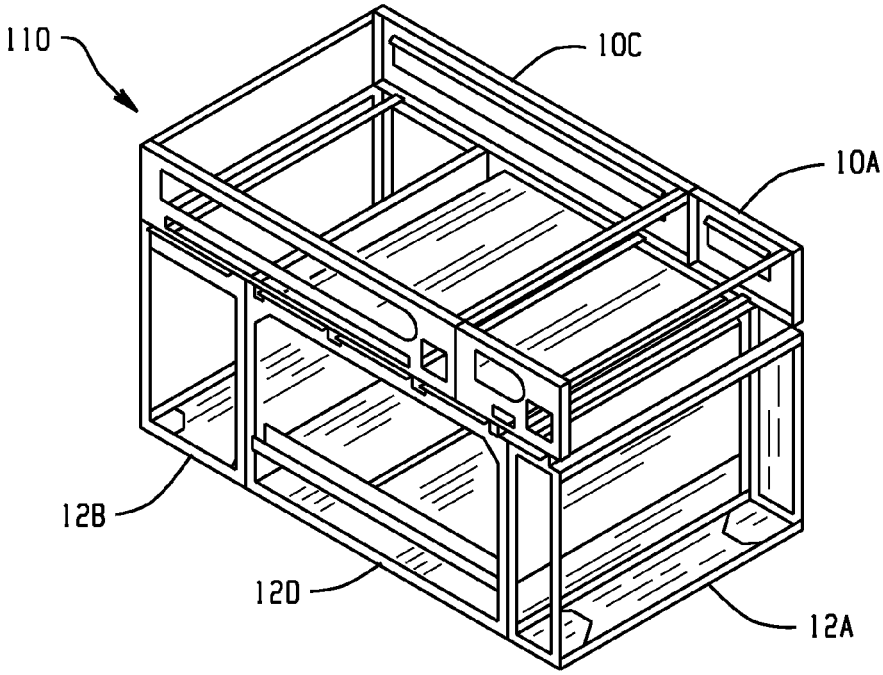
FIG. 11 shows a frame assembled view of another range unit configuration.

FIGS. 9 and 10 illustrated a range unit configuration 108 having the same width as range unit 106, but with a different cooktop configuration formed by top frame units 10A and 10C. This configuration would typically only be used where the two different width top frame units are preassembled with respective, different type cooking systems. The range unit configuration 110 in FIG. 11 uses the same frame units as range unit configuration 106 (FIGS. 9 and 10), but reverses the position of the top frame units 10A and 10C.

Figure 12:
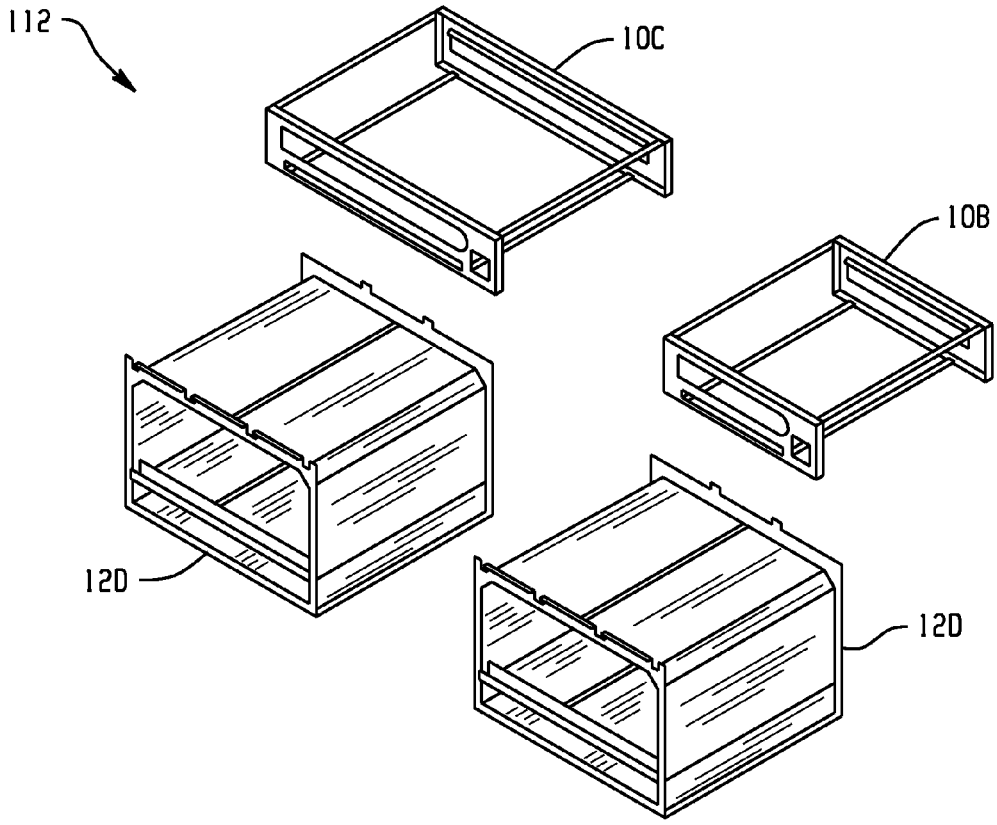
FIGS. 12 and 13 show frame exploded and frame assembled views of another range unit configuration.
Figure 13:
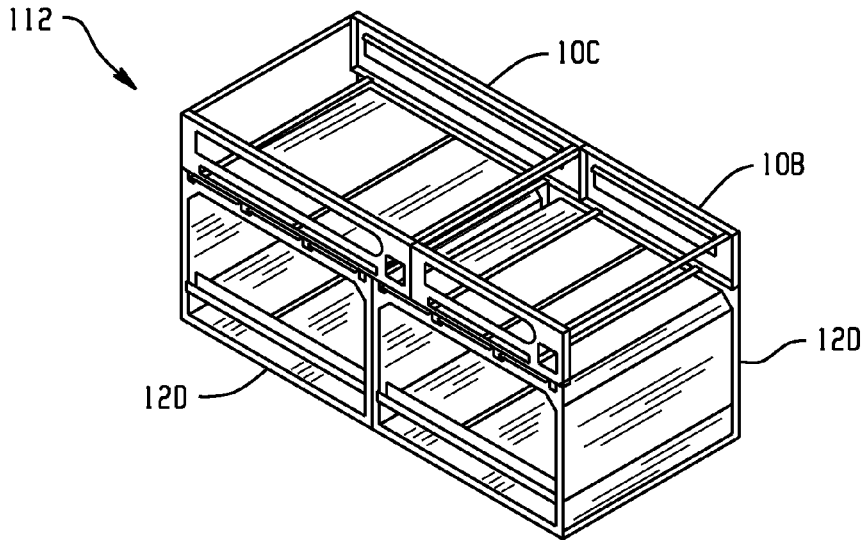
Figure 14:
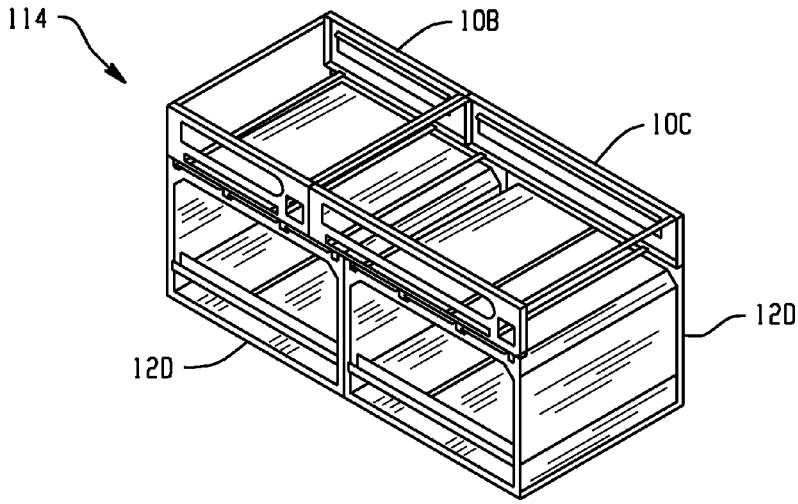
FIG. 14 shows a frame assembled view of another range unit configuration.

FIGS. 12 and 13 illustrate a range unit configuration 112, in which the top frame assembly is formed by top frame units 10B and 10C and the base frame assembly is formed by two joined base frame units 12D. The two top frame units 10B and 10C could be preassembled with the same type cooking system or with respective different type cooking systems as needed. In one implementation range unit 106 is a 60" wide range unit. The range unit configuration 114 in FIG. 14 uses the same frame units as range unit configuration 112 (FIGS. 12 and 13), but reverses the position of the top frame units 10B and 10C.

Figure 15:
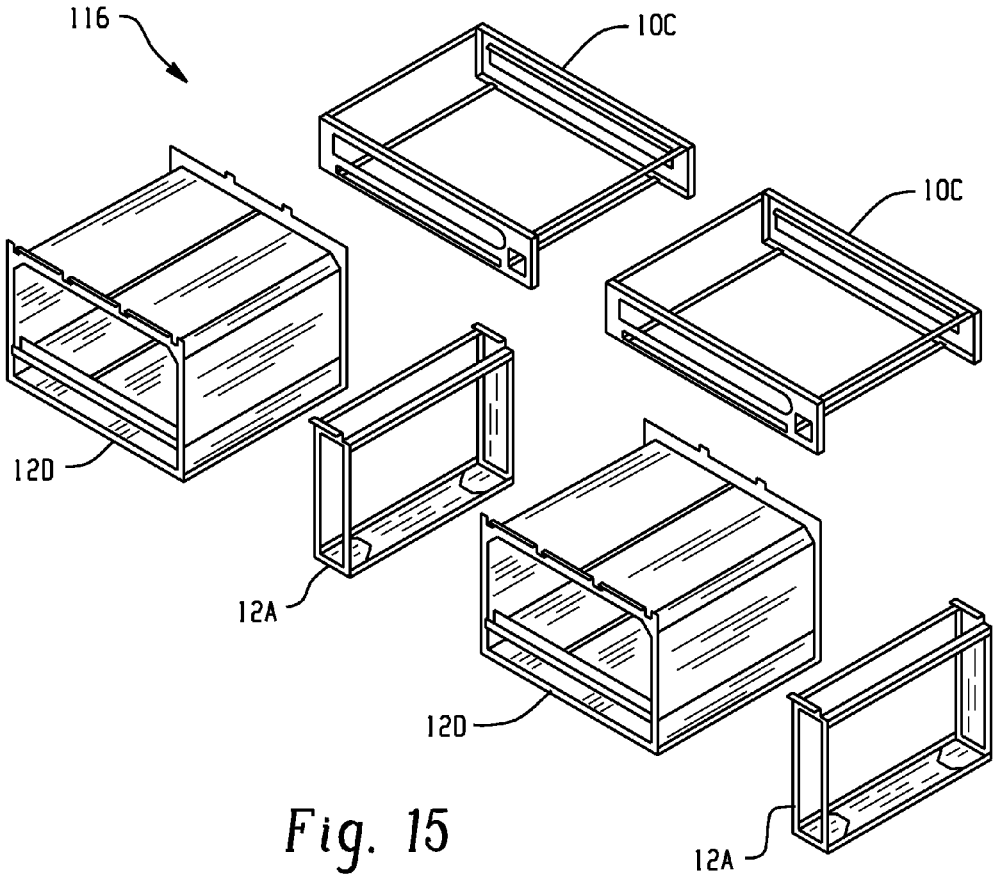
FIGS. 15 and 16 show frame exploded and frame assembled views of another range unit configuration.
Figure 16:
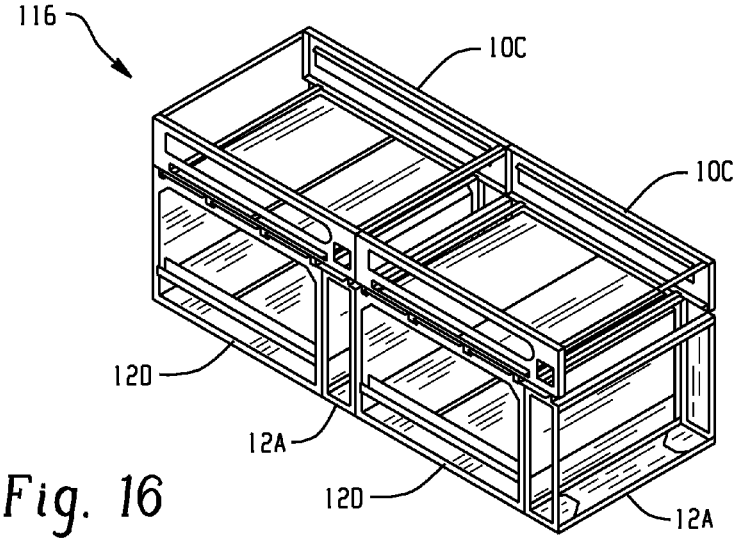

Referring to FIGS. 15 and 16, a range unit configuration 116 is shown, which includes a top frame assembly formed by two top frame units 10C and a base frame assembly formed by two base frame units 12D and two base frame units 12A. The two top frame units 10C could be preassembled with the same type cooking system or with respective different type cooking systems as needed. In one implementation range unit 116 is a 72" wide unit.

Figure 17:
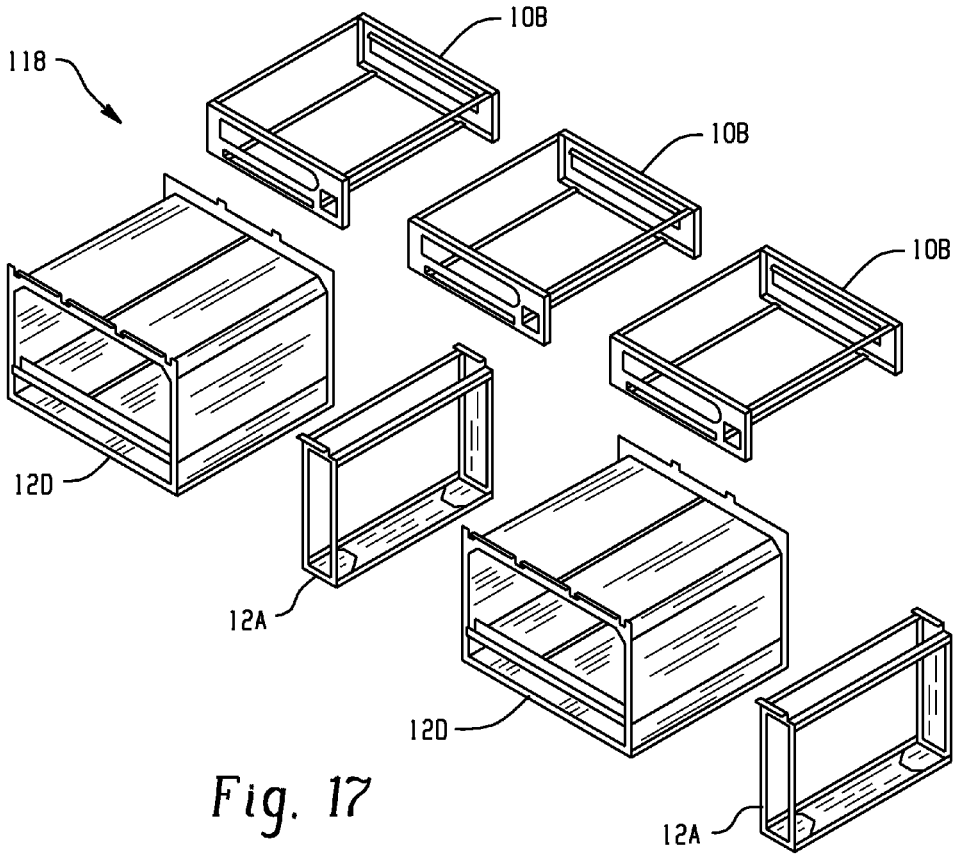
FIGS. 17 and 18 show frame exploded and frame assembled views of another range unit configuration.
Figure 18:
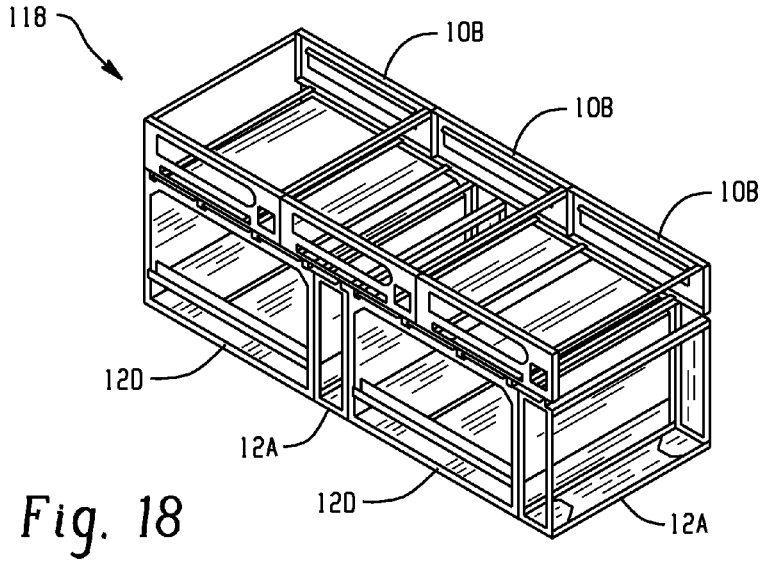

FIGS. 17 and 18 illustrate a range unit configuration 118 having the same width as unit 116, but different cooktop configuration formed by a top frame assembly with three top frame units 10B. Typically, at least one of the top frame units 10B would be preassembled with cooking system type that is different than the cooking system type preassembled into the other two top frame units 10B.

Figure 19:
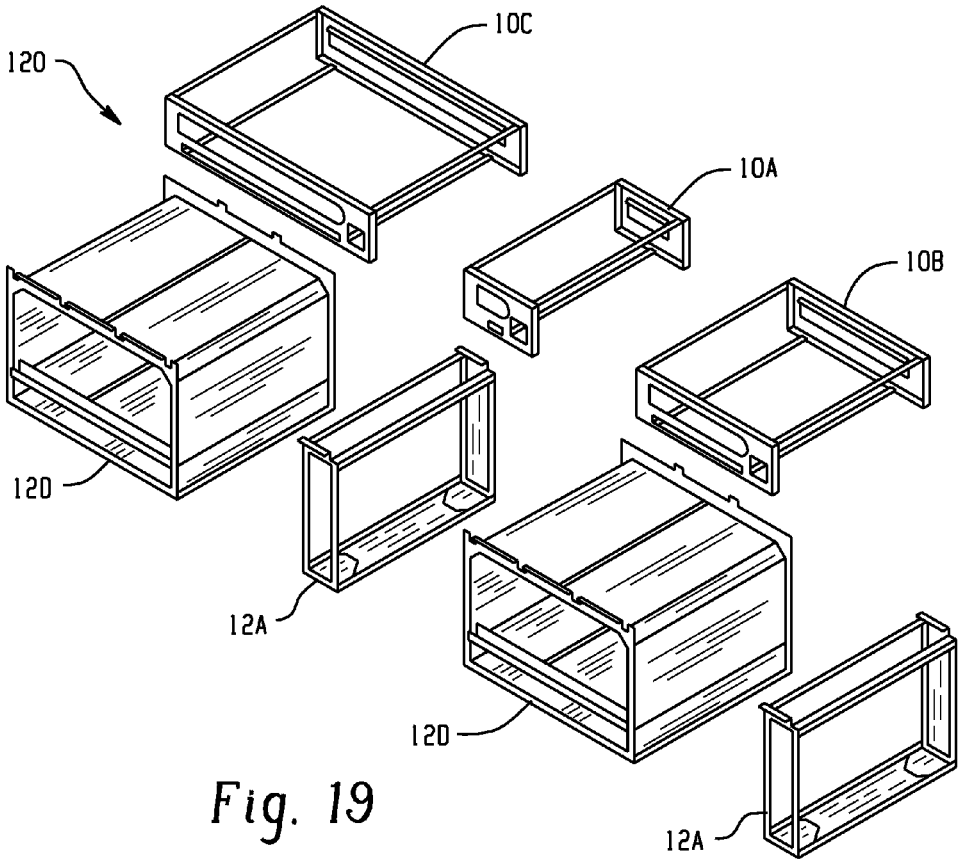
FIGS. 19 and 20 show frame exploded and frame assembled views of another range unit configuration.
Figure 20:
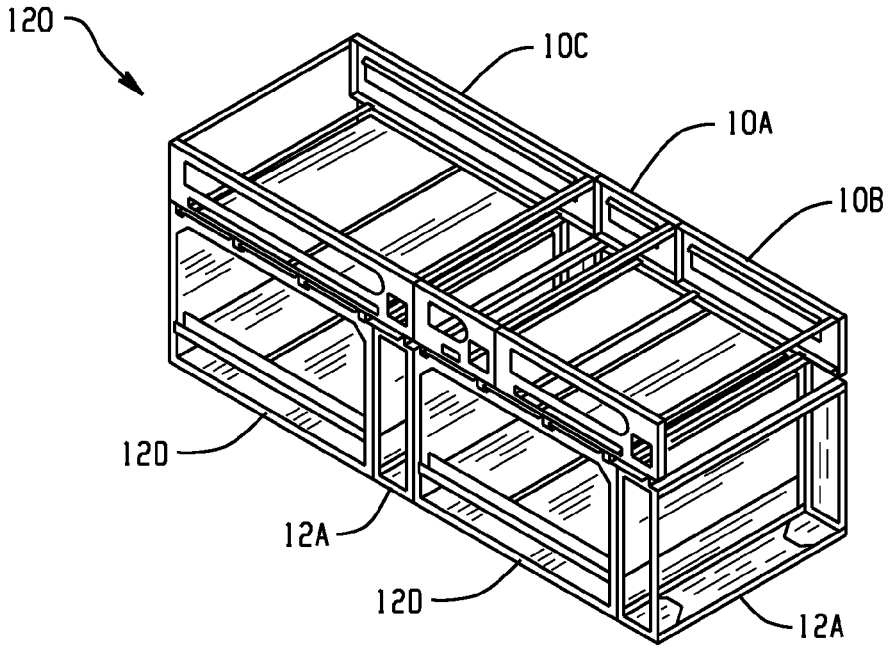
Figure 21:
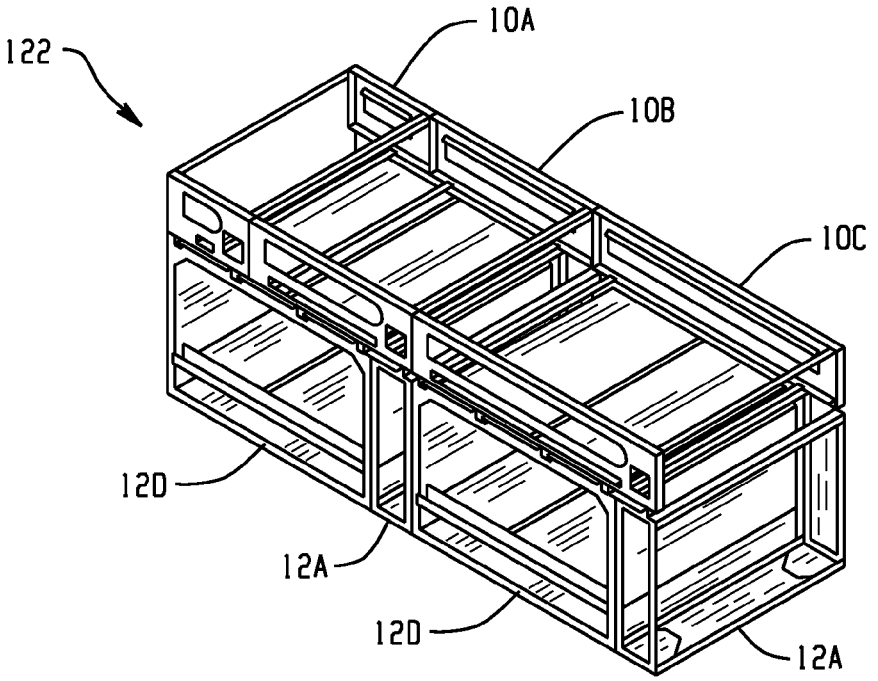
FIG. 21 shows a frame assembled view of another range unit configuration.

FIGS. 19 and 20 illustrate a range unit configuration 120 in which the top frame assembly is formed by top frame units 10A, 10B and 10C, and the base frame assembly is formed by two base frame units 12A and tow base frame units 12D. Range unit 120 has the same width as range units 116 and 118. Typically, the top frame units would be preassembled with three different, respective cooking system types. FIG. 21 illustrates a range unit configuration 122 made up of the same frame units as range unit 120, but with the order of the top frame units 10A, 10B and 10C rearranged.

Figure 22:
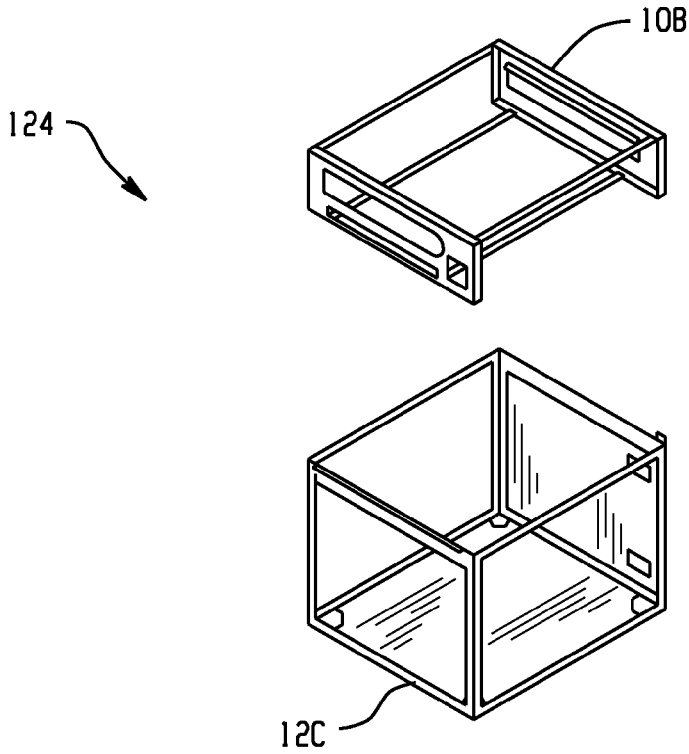
FIGS. 22 and 23 show frame exploded and frame assembled views of another range unit configuration.
Figure 23:
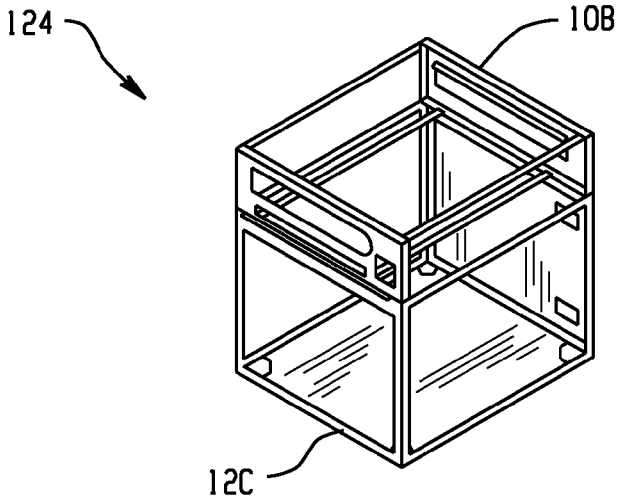

FIGS. 22 and 23 illustrate a range unit configuration 124 formed by placement of top frame unit 10B atop base frame unit 12C.

Figure 24:
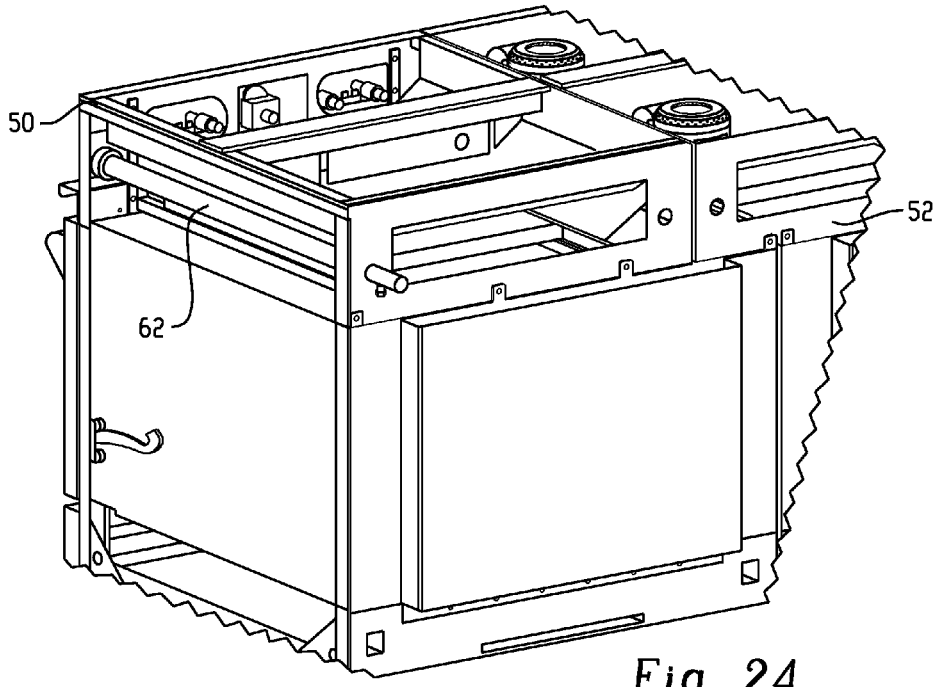
FIGS. 24 and 25 show partial perspectives of a range unit with gas manifold system.
Figure 25:
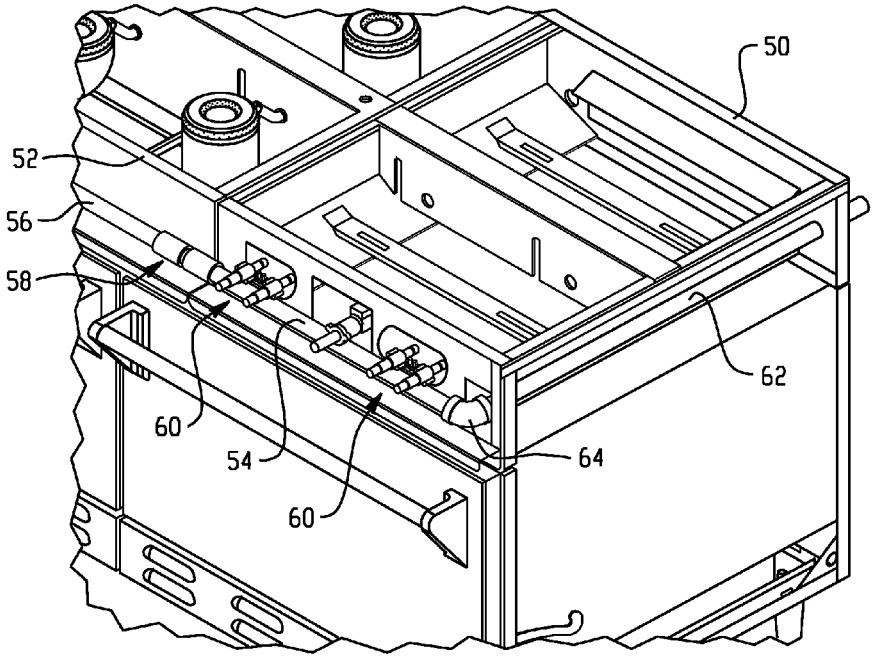
Figure 26:
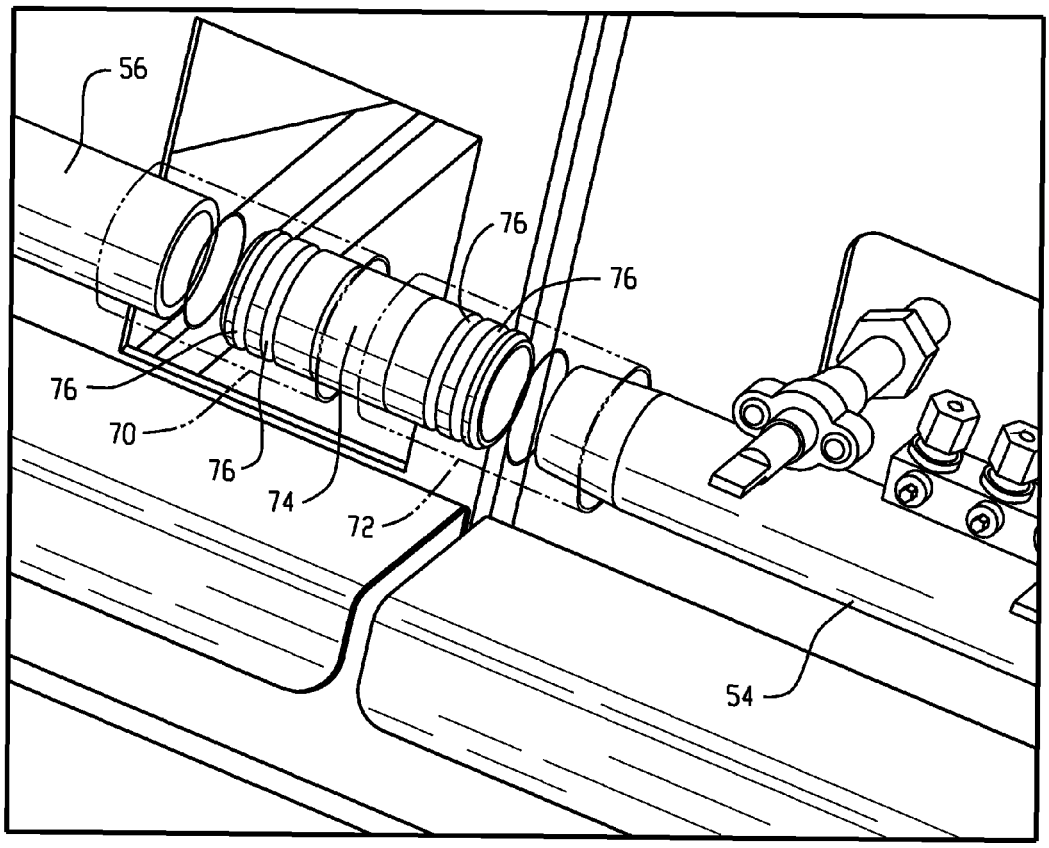
FIG. 26 shows an enlarged partial perspective of one embodiment of a coupler assembly for a range gas manifold system.

FIGS. 24 and 25 show rear and front perspectives of part of a range unit, with gas flow tubing illustrated. As shown in FIG. 25, top frame units 50 and 52 include a respective cooking system type and a respective laterally extending gas manifold 54 and 56 thereon. In the illustrated embodiment, each gas manifold is mounted on a front side of the frame, but the manifolds could also be mounted at the rear side of the frame. Suitable mounting brackets for the manifolds may be used. The gas manifolds 54 and 56 are preferably preassembled on each frame unit, and then coupled together (e.g., via a coupling assembly 58) upon mounting of the frame units on the base frame assembly to form a common, laterally extending gas manifold for the overall range unit. In this regard, if there are more than two top frame units used in forming the range, the gas manifold of all of the top frame units may be similarly coupled together to form the common, laterally extending gas manifold for the overall range unit. As illustrated, various control valves 60 may be associated with the gas manifold of each top frame unit, and may likewise form part of the preassembled components incorporated into each top frame unit. Typically, the gas manifold of one of the end top frame units will be selected for connection to a rearwardly extending gas feed pipe that, upon installation of the range unit, will be used to feed the common, laterally extending gas manifold of the range unit.

In one implementation, the gas manifold that is preassembled onto each top frame unit includes opposite ends, both of which are right hand threaded. The rear feed tube 62 is coupled to one end of the manifold via an elbow connector 64. The coupling assembly 58 may be any suitable components. However, in a preferred arrangement the coupling assembly 58 is formed by a pair of female couplers 70 and 72, each of which has one end internally threaded for connection to one end of the gas manifolds 56 and 54. The opposite end of each coupler has an internal end that is unthreaded for slidingly receiving one end of male coupler 74. Each end of the male coupler 74 includes a pair of spaced apart seats 76, each of which receives a sealing member such as an o-ring or other type gasket. This type of coupler assembly facilitates coupling and decoupling of top frame assemblies in the manufacturing/assembly facility and/or in the field, by simply moving one top frame unit laterally away from the other top frame unit. Facilitating this process in the fields makes range units field adaptable for reconfiguration by either (i) varying the side-by-side position of the existing top frame units of a range or (ii) removing one or more of the top frame units of a range and replacing them with new top frame modules.

It is recognized that in assembling the various frame units of a given range, fasteners may be used to hold the frame units together. Accordingly, the lateral sides of each top frame unit may be formed with openings at predetermined locations that are placed to align with the similar openings of another top frame unit that may be placed adjacent to it during assembly. Similarly, the upper frame pieces of each base frame unit and the lower frame pieces of each top frame unit may be formed with openings that will align to facilitate fastener securing.

Figure 27:
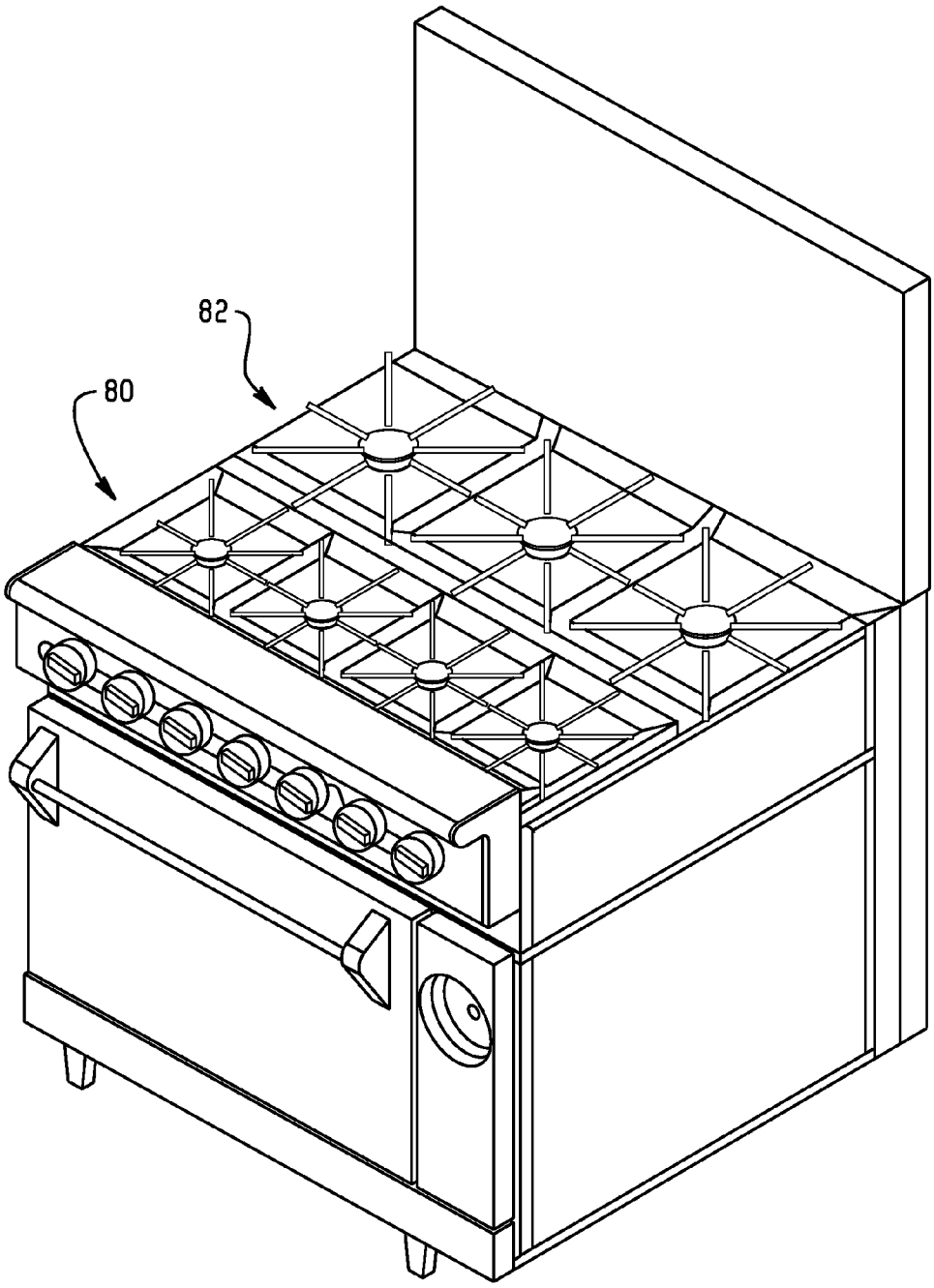
FIG. 27 shows a perspective view of one embodiment of a range with a space saver arrangement for open top burners.

With respect to cooking system types, the typical open top gas burner arrangement provided in a range provides either 11 or 12 inch wide grates over each of the side-by-side burners, where the burners are spaced apart 11 or 12 inches from center to center. In a typical 36" wide range this configuration limits the 36" range to 3 side-by-side burners in front and 3 side-by-side burners in back. As illustrated in FIG. 27, by providing 9" wide grates in the front row 80 of a range, with burners spaced apart 9 inches from center to center, four front burner positions are achieved, along with the three larger, back burner positions in the rear burner row 82. This configuration may be advantageous in certain kitchens where 8" saute pans are the most commonly utilized cooking vessel, thus not requiring the 11 or 12" wide burner positions. The 9" wide front burner positions could also be incorporated into other sizes, including 48", 60" and 72" wide units.

It is to be clearly understood that the above description is intended by way of illustration and example only, is not intended to be taken by way of limitation, and that various changes and modifications are possible.

What is claimed is:

1. A range unit, comprising:

a base assembly comprised of multiple modular base units having respective widths that provide a base width of WB;

a cooktop assembly mounted atop the base assembly, the cooktop assembly comprising at least one modular cooktop unit and a cooktop width of WT, where WT=WB;

wherein the base assembly includes a first modular base unit of width WB1, a second modular base unit of width WB2 and a third modular base unit of width WB3, where WB1<WB2<WB3 and WB1+WB2+WB3=WB;

wherein the cooktop assembly includes a first modular cooktop unit of width WT1 and a second modular cooktop unit of width WT2, where WT1+WT2=WT.

2. The range unit of claim 1, wherein:

the first modular cooktop unit includes a first laterally extending gas manifold structure mounted thereon, the second modular cooktop unit includes a second laterally extending gas manifold structure mounted thereon, one end of the first laterally extending gas manifold structure aligns with one end of the second laterally extending gas manifold structure, a coupling member connects the aligned ends of the first and second laterally extending gas manifold structures to form a common laterally extending gas manifold of the range unit.

3. The range unit of claim 2, wherein:

the first laterally extending gas manifold structure is mounted on a front portion of the first modular cooktop unit, the second laterally extending gas manifold structure is mounted on a front portion of the second modular cooktop unit.

4. The range unit of claim 3, wherein:

the coupling member comprises a sliding coupling assembly that facilitates uncoupling of the first and second gas laterally extending gas manifold structures via lateral movement of at least one of the first and second modular cooktop units.

5. The range unit of claim 1 wherein WT1=WT2 and WT1 is not equal to WB1, WB2 or WB3.

6. The range unit of claim 1 wherein WT1<WT2.

7. A range unit, comprising:

a base assembly comprised of multiple modular base units having respective widths that provide a base width of WB;

a cooktop assembly mounted atop the base assembly, the cooktop assembly comprised of multiple modular cooktop units that provide a cooktop width of WT, where WT=WB;

wherein the base assembly includes a first modular base unit of width WB 1 and a second modular base unit of width WB2, where WBl<WB2 and WB1+WB2=WB;

wherein the cooktop assembly includes a first modular cooktop unit of width WT1 and a second modular cooktop unit of width WT2, where WT1+WT2=WT;

wherein WT1 is not equal to WB1 or WB2, and WT2 is not equal to WB1 or WB2;

wherein the first and second modular base units are connected directly to each other.

8. A method of manufacturing range units of a variety of configurations and sizes, where each range unit includes a cooktop assembly supported atop a base assembly, the method comprising:

providing a modular base system including first, second and third base units of different widths respectively;

providing a modular cooktop system including first, second and third cooktop units of different widths respectively;

(1) when manufacturing a first range unit having a first specified width and a first cooktop configuration:

utilizing the first and third base units and the third cooktop unit to assemble the first range unit;

(2) when manufacturing a second range unit having the first specified width and a second cooktop configuration that is different than the first cooktop configuration:

utilizing the first and third base units and the first and second cooktop units to assemble the second range unit;

(3) when manufacturing a third range unit having a second specified width that is greater than the first specified width:

utilizing two third base units and the second and third cooktop units to assemble the third range unit.

9. The method of claim 8 wherein:

the first cooktop configuration provides only one type of cooktop cooking system, in step (1) the third cooktop unit is preassembled with a single cooking system type prior to mounting on the base units;

the second cooktop configuration provides two different types of top cooking systems, in step (2) the first cooktop unit is preassembled with a first cooking system type and the second cooktop unit is preassembled with a second cooking system type prior to mounting on the base units;

in step (3) the second cooktop unit is preassembled with a cooking system type and the third cooktop unit is preassembled with a cooking system type.

10. The method of claim 9 wherein in step (3) the cooking system type of the preassembled second cooktop unit is different than the cooking system type of the preassembled third cooktop unit.

11. The method of claim 9 wherein:

in step (1) the preassembled third cooktop unit includes a laterally extending gas manifold mounted thereon;

in step (2) the preassembled first cooktop unit includes a laterally extending gas manifold mounted thereon and the preassembled second cooktop unit includes a laterally extending gas manifold mounted thereon, once mounted on the base units, the laterally extending gas manifold of the preassembled first cooktop unit is connected to the laterally extending gas manifold of the preassembled second cooktop unit to form a common, laterally extending gas manifold for the second range unit;

in step (3) the preassembled second cooktop unit includes a laterally extending gas manifold mounted thereon and the preassembled third cooktop unit includes a laterally extending gas manifold mounted thereon, once mounted on the base units, the laterally extending gas manifold of the preassembled second cooktop unit is connected to the laterally extending gas manifold of the preassembled third cooktop unit to form a common, laterally extending gas manifold for the third range unit.

12. A method of manufacturing range units of a variety of configurations and sizes, where each range unit includes a cooktop assembly supported atop a base assembly, the method comprising:

providing a modular base system including first, second and third base units of different widths WB1, WB2 and WB3 respectively, where WB1<WB2<WB3;

providing a modular cooktop system including first, second and third cooktop units of different widths WT1, WT2 and WT3 respectively, where WT1<WT2<WT3;

(1) when manufacturing a first range unit having a specified width WU1 and cooktop configuration C1:

utilizing the first and third base units and the third cooktop unit to assemble the first range unit, where WT3=(WB1+WB3)=WU1;

(2) when manufacturing a second range unit having a specified width WU1 and cooktop configuration C2:

utilizing the first and third base units and the first and second cooktop units to assemble the second range unit, where (WT1+WT2)=(WB1+WB3)=WU1;

(3) when manufacturing a third range unit having a specified width WU2 and cooktop configuration C3, where WU2>WU1:

utilizing the first, second and third base units and two second cooktop units to assemble the third range unit, where (WT2+WT2)=(WB1+WB2+WB3)=WU2;

(4) when manufacturing a fourth range unit having specified width WU2 and cooktop configuration C4:

utilizing the first, second and third base units and the first and third cooktop units to assemble the fourth range unit, where (WT1+WT3)=(WB1+WB2+WB3)=WU2.

13. The method of claim 12 wherein:

cooktop configuration C1 provides only one type of top cooking system, in step (1) the third cooktop unit is preassembled with a single cooking system type prior to mounting on the base units;

cooktop configuration C2 provides two different types of top cooking systems, in step (2) the first cooktop unit is preassembled with a first cooking system type and the second cooktop unit is preassembled with a second cooking system type prior to mounting on the base units.

14. The method of claim 12 wherein:

in step (1) the preassembled third cooktop unit includes a laterally extending gas manifold mounted thereon;

in step (2) the preassembled first cooktop unit includes a laterally extending gas manifold mounted thereon and the preassembled second cooktop unit includes a laterally extending gas manifold mounted thereon, once mounted on the base units, the laterally extending gas manifold of the preassembled first cooktop unit is connected to the laterally extending gas manifold of the preassembled second cooktop unit to form a common, laterally extending gas manifold for the second range unit.

15. The method of claim 14 wherein:

in step (1) the laterally extending gas manifold of the preassembled third cooktop unit is located toward a front side of the preassembled third cooktop unit;

in step (2) the laterally extending gas manifold of the preassembled first cooktop unit is located toward a front side of the preassembled first cooktop unit and the laterally extending gas manifold of the preassembled second cooktop unit is located toward a front side of the preassembled second cooktop unit.

16. The method of claim 12, wherein:

cooktop configuration C1 provides only one type of top cooking system, in step (1) the third cooktop unit is preassembled with a single cooking system type prior to mounting on the base units;

cooktop configuration C2 provides two different types of top cooking systems, in step (2) the first cooktop unit is preassembled with one cooking system type and the second cooktop unit is preassembled with a different cooking system type prior to mounting on the base units;

cooktop configuration C3 is different than cooktop configuration C4, in step (3) each of the second cooktop units is preassembled with a respective single cooking system type prior to mounting on the base units, and in step (4) the first cooktop unit is preassembled with one cooking system type and the second cooktop unit is preassembled with a different cooking system type prior to mounting on the base units.

17. The method of claim 16, wherein in step (3) both of the second cooktop units are preassembled with the same cooking system type.

18. The method of claim 12, wherein:

(5) when manufacturing a fifth range unit having a specified width WU3 and cooktop configuration C5:

utilizing two third base units and the second and third cooktop units to assemble the fifth range unit, where (WT2+WT3)=(WB3+WB3)=WU3;

(6) when manufacturing a sixth range unit having a specified width WU4 and cooktop configuration C6:

utilizing two first base units, two third base units, and two third cooktop units to assemble the sixth range unit, where (WT3+WT3)=(WB1+WB1+WB3+WB3)=WU4;

(7) when manufacturing a seventh range unit having a specified width WU4 and cooktop configuration C7:

utilizing two first base units, two third base units, and three second cooktop units to assemble the seventh range unit, where (WT2+WT2+WT2)=(WB1+WB1+WB3+WB3)=WU4; and (8) when manufacturing a eighth range unit having a specified width WU4 and cooktop configuration C8:

utilizing two first base units, two third base units, one first cooktop unit, one second cooktop unit and one third cooktop unit to assemble the eighth range unit, where (WT1+WT2+WT3)=(WB1+WB1+WB3+WB3)=WU4.

19. The method of claim 18, wherein:

cooktop configuration C1 provides only one type of top cooking system, in step (1) the third cooktop unit is preassembled with a single cooking system type prior to mounting on the base units;

cooktop configuration C2 provides two different types of top cooking systems, in step (2) both the first cooktop unit is preassembled with one cooking system type and the second cooktop unit is preassembled with a different cooking system type prior to mounting on the base units;

cooktop configuration C3 is different than cooktop configuration C4, in step (3) each of the second cooktop units is preassembled with a respective single cooking system type prior to mounting on the base units, and in step (4) the first cooktop unit is preassembled with one cooking system type and the second cooktop unit is preassembled with a different cooking system type prior to mounting on the base units;

cooktop configurations C6, C7 and C8 are different from each other, and:

in step (6) each of the third cooktop units is preassmbled with a respective single cooking system type prior to mounting on the base units;

in step (7) each of the second cooktop units is preassembled with a respective single cooking system type prior to mounting on the base units, and at least one of the second cooktop units has a cooking system type different than that of the other two second cooktop units;

in step (8) the first cooktop unit is preassembled with one cooking system type, the second cooktop unit is preassembled with a different cooking system type and the third cooktop unit is preassembled with still a different cooking system type prior to mounting on the base units.

* * * * *